US005240459A

United States Patent [19]

Herbert

[11] Patent Number: 5,240,459

[45] Date of Patent: Aug. 31, 1993

[54] RACETRACK DESIGN

[76] Inventor: Richard A. Herbert, Suite 712, 120 Oak Brook Center, Oak Brook, Ill. 60521

[21] Appl. No.: 843,631

[22] Filed: Feb. 28, 1992

Related U.S. Application Data

[63] Continuation-in-part of Ser. No. 675,486, Mar. 26, 1991, abandoned.

[51] Int. Cl.[5] ..... A63K 1/00

[52] U.S. Cl. ..... 472/86

[58] Field of Search ..... 472/85-87

[56] References Cited

U.S. PATENT DOCUMENTS

| | | |
|---|---|---|
| 1,634,326 | 7/1927 | Jennings . |
| 3,099,247 | 7/1963 | Bieber . |
| 3,127,870 | 4/1964 | Bieber . |
| 3,166,314 | 1/1965 | Weinstein . |
| 3,203,396 | 8/1965 | Carmichael, Jr. . |
| 3,408,066 | 10/1968 | Weinstein . |
| 3,994,491 | 11/1976 | Scotte et al. . |

FOREIGN PATENT DOCUMENTS 454553 10/1950 Italy .

OTHER PUBLICATIONS

"Dean's List" by Dean A. Hoffman, *Hoof Beats*, p. 14, Feb. 1991.

Two drawings attached as Exhibits 1 and 2 with an affidavit signed by the inventor.

R. A. Herbert, M.D., "Harness Racing: Handicapping and History" *Midwest Harness Horse*, pp. 22-23, Nov., 1990.

R. A. Herbert, M.D., "Harness Racing: Handicapping and History" *Midwest Harness Horse*, p.32, Dec. 1990.

*Primary Examiner*—Richard E. Chilcot, Jr.
*Assistant Examiner*—Beth A. Aubrey
*Attorney, Agent, or Firm*—Dean A. Monco

[57] ABSTRACT

A means and method for modifying the width of a racing surface of a racetrack having a movable barrier positioned between a stationary outer barrier and a stationary inner barrier, the movable barrier comprising pylons having a removable tethering means connecting the movable barrier to the inner stationary barrier, and also having a limiting means to enable the user to place the movable pylons in generally the same position prior to the beginning of every race. During the course of the race, the user will move the movable pylons off of the racing surface, thus increasing the width of the racing surface available to the horse and driver. In another embodiment, an inner lane of approximately 8-10 feet exists to increase the width of the racing surface during the stretch portion of the race.

20 Claims, 4 Drawing Sheets

48a
32b
48b
42
40
14
30
18
44
46
26c
58a
58b
20
16
34
36a
38
9

RACETRACK DESIGN

This application is a continuation-in-part of U.S. application Ser. No. 07/675,486, filed on Mar. 26,1991 (now abandoned).

BACKGROUND OF THE INVENTION

This invention relates to a means and method for expanding the width of a racing surface of a racetrack for harness horses, and more particularly, to the placement of an inner boundary so as to increase the width of the racing surface during the stretch portion of the race.

THE PRIOR ART

Organized harness races in the United States began approximately 150 years ago in the East and Midwest. The configuration of the racetracks varied from location to location. By the middle of the 19th Century, uniform racetracks for harness racing such as the Union Course in New York came into existence. Many of these harness racetracks were one (1) mile in circumference but many more were a half-mile to five-eighths of a mile in length. Cost factors as well as availability of land determined the general configuration of these racetracks.

Harness horses pull a race bike called sulky in which the driver sits. The driver controls the speed and direction of the horse using the reins and other harness gear. Because the sulky is typically about six (6) feet wide, the harness racehorse is not as maneuverable as his thoroughbred counterpart who carries the rider on his back and has no equipment to pull through any openings that may exist while the race is being run. In the 1940's, the pioneer parimutuel tracks for harness racing opened in New York City and Chicago. These included New York's Roosevelt Raceway and Chicago's Maywood Park. Almost all harness racing on which betting was permitted was conducted on big city half-mile tracks. The standard race distance historically is one (1) mile.

The harness horses are able to travel the mile distance on a one mile track in much faster times than they are on a half-mile or five-eighths mile oval, for the obvious reason that they have fewer turns to make. The half-mile tracks require the harness horses to make two complete trips around the track. These half-mile racetracks were quite popular because they provided racing fans with the opportunity to watch the race "close-up".

However, the half-mile racetracks provide a major disadvantage regarding the maneuverability of horses as they approach the finish line. Typically, the one mile tracks provide a stretch or ending portion of a race of over typically 1,000 feet, and possibly as long as a quarter of a mile. This lengthy stretch permitted the trailing harness horses running at the one mile tracks to position themselves to the outside of the front running horses to make a final charge at the leaders without consuming substantial energy.

In contrast, the half-mile or five-eighths mile race tracks typically had stretch portions of only four to five hundred (400-500) feet. A horse not positioned among the leaders by the three quarter mile pole would find himself forced to "go wide" in the final turn in order to get around the leaders, who face no such handicap. This would add considerable distance to the length of the race for any horses positioned far back of the leaders. Any driver attempting to direct his horse to the inside portion of the half-mile race track would find himself blocked by the horses in front of him or by the permanent interior rail defining the racing surface.

Because of the physical limitations of the half-mile tracks, the horses assigned the inside post positions (1-2-3), win a very high percentage of the races. As competition for the entertainment and gambling dollar increased, the disadvantages of the half-mile harness racetracks became more evident. The number of horses winning from the first three post positions had the effect of driving down the odds of those horses, leading to boredom, frustration and non-attendance at these tracks.

One solution to this problem is to convert the half-mile and five-eighths mile tracks to one mile racetracks. Where this has happened, attendance and betting handle have increased. However, this option is not available for half-mile tracks which are confined by their geography.

It is an object of the present invention to provide a means and method for increasing the width of the racing surface of a race track without the need to increase the racetrack's overall dimensions, to provide more room to maneuver during a race.

It is a further object of the present invention to provide a means for permitting "blocked" horses a better opportunity for winning the race.

It is a further object of this invention to provide movable pylons which may be placed at selected positions at a fixed perpendicular length from a permanent interior rail or "eurorail" to define, together with a permanent outer rail, a racing surface. The "eurorail" is defined as the inner boundary of a racetrack comprising flexible vertical pylons not connected to one another by any horizontal element, so as to provide for greater safety to driver and horse.

It is a further object of this invention to have movable pylons capable of being moved during the course of a race so as to increase the width of the racing surface during the stretch portion of a race, in order to equalize the chances for trailing horses to win races on shorter racetracks.

It is a further object of this invention to have removable tether cords connecting the movable pylons to vertical posts or pylons forming the permanent interior rail or eurorail, in order to remove the inherent advantage of inside post positions on smaller racetracks, and to permit expanded tactical and strategic maneuvers by drivers on shorter racetracks which are currently absent.

It is a further object of this invention to employ movable pylons having a particular figuration to avoid or minimize injuries to horses and drivers from collisions during the running of a race.

It is a further object of this invention to provide retractable limiting means for enabling a user to easily place the movable pylons in the desired location consistently.

SUMMARY OF THE INVENTION

The present invention relates to a means and method for increasing the size of the racing surface of a racetrack in the home stretch during the course of the race, without increasing the size of the physical facilities. Specifically, a series of movable pylons are connected to a series of vertical posts or pylons forming a recessed interior permanent barrier or eurorail by means of removable tether cords of a fixed length. At the beginning of the race, the movable pylons are placed on the racing surface a fixed distance from the permanent interior rail or eurorail to define the interior border or boundary of the racing surface for the first lap of the race.

As the race begins, the harness horses make one (1) complete lap around the half-mile or five-eighths mile race track. As the horses and sulkies pass each of the movable pylons positioned on the stretch portion of the racing surface, the pylons are removed by an individual and placed behind the permanent interior rail or eurorail. As the harness horses enter the stretch portion a second time to complete the race, the width of the stretch portion of the race track will have increased by the distance from the permanent rail or eurorail to the movable pylon. This will permit the drivers to maneuver their horses toward the permanent interior rail or eurorail, thus providing more racing room for the drivers to challenge the leading horses.

Each of the movable pylons is of sufficient weight to prevent undesired movement from such effects as wind, but yet is light enough to move if impacted by horse or sulky during a race. The movable pylons have resilient ramped surfaces to avoid or minimize injuries to drivers and horses from impact.

The pylons and the interior permanent rail or eurorail each have receptacles for receiving a clip affixed to each end of the tether cord. Retractable, rotatable limiting means are mounted to the vertical posts or pylons of the interior rail or eurorail to give the user visual guidance regarding where to place the movable pylon prior to the start of the race. The limiting means insures that the movable pylon will be placed in the same general location before each race begins.

In another embodiment, no moveable pylons are used. Rather, the vertical posts or pylons which form a recessed interior, permanent barrier or eurorail are positioned essentially parallel to the outer rail such that an inner lane is formed. While the inner lane in this embodiment may exist throughout the racetrack, rules may prevent the harness horses from passing in the inner lane until the final stretch.

These and other objects of the invention will become apparent through the accompanying drawings and the detailed description thereof.

DESCRIPTION OF THE DRAWINGS

FIG. 2B is a top perspective view of the racetrack having moveable pylons or alternatively with laser-light demarcators turned on.

DESCRIPTION OF THE PREFERRED EMBODIMENT

Figure 1:
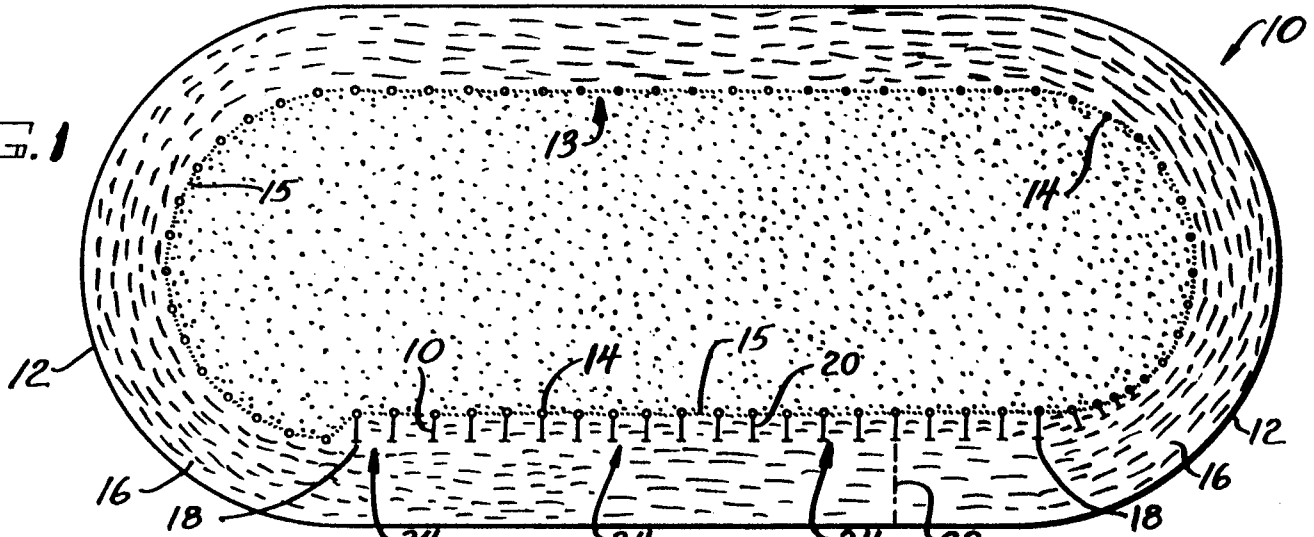
FIG. 1 is a top perspective view of a race track showing the position of the movable pylons having tether cords attached.

FIG. 1 of the preferred embodiment shows a race track 10 which would be characterized as a "half-mile track", although this invention maybe used on a racetrack of any length. The stationary outer rail or barrier 12 is positioned around the outer circumference of the race track 10. A stationary inner barrier 13, comprising a series of stationary vertical posts or pylons 14 driven in the ground a prescribed distance from one to another, is positioned within the interior of the race track 10. These vertical posts or pylons 14 may be connected by means of a horizontal rail 15 or may simply form a eurorail. A racing surface 16 is located between the stationary outer barrier 12 and the stationary inner barrier 13. The stationary inner barrier 13 will have generally the same configuration as the outer barrier 12, or it may be a eurorail except for those portions in which the user wishes to enlarge the width of the racing surface 16, as shown in FIG. 1.

At those desired locations, movable barriers or pylons 18 are positioned on the racing surface 16. The movable pylons 18 are connected to the stationary inner vertical posts or pylons 14 by means of a tether cord 20. The tether cord 20 enables the movable pylons 18 to be placed at a desired fixed distance from the stationary inner posts or pylons 14 before every race. A start-finish line 22 defines the start and finish of a horse race.

The portion of the racing surface in FIG. 1 having the movable pylons 18 is an ending or stretch portion 24. In FIG. 1, the vertical posts or pylons 14 of the permanent inner barrier 13 have been recessed toward the center of the race track 10 along the stretch portion 24. However, the movable pylons 18 may be placed at any desired position around the racing surface 16.

Figure 2:
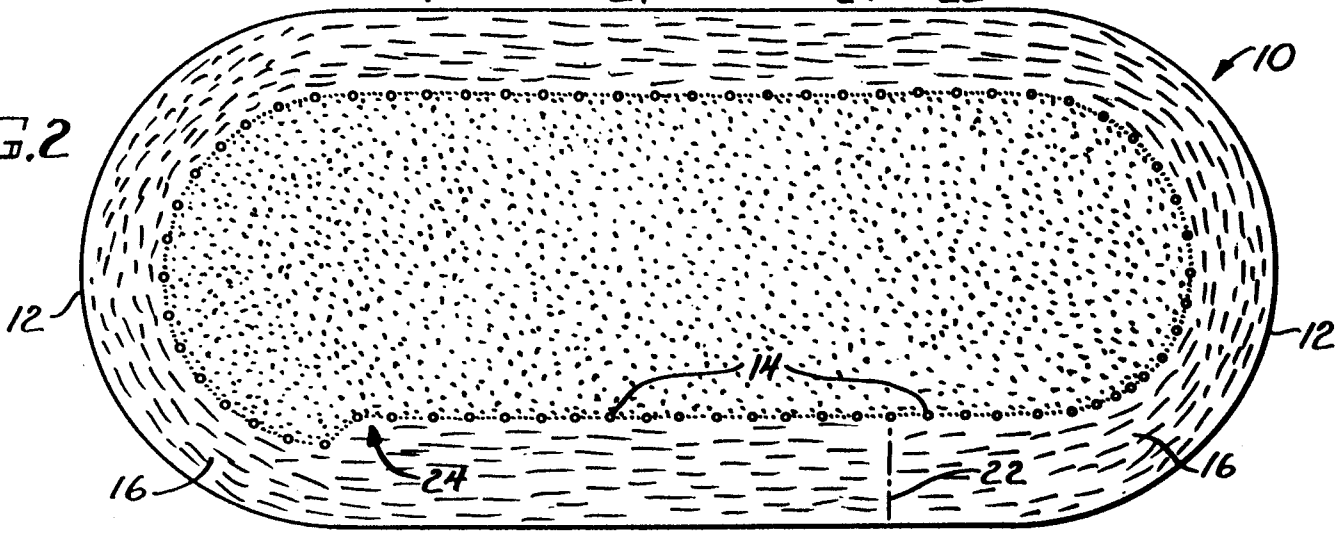
FIG. 2 is a top perspective view showing the race track with the movable pylons removed or the racetrack having no moveable pylons at all or alternatively with laser-light demarcators turned off.
Figure 2C:
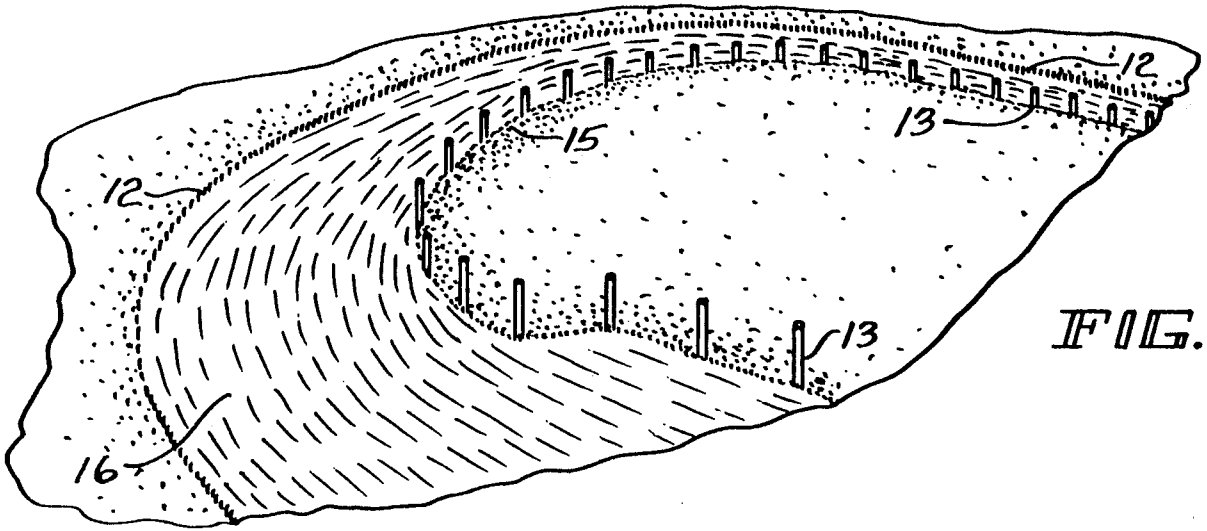
FIG. 2C is a perspective view of the race track of FIG. 2B.
Figure 2B:
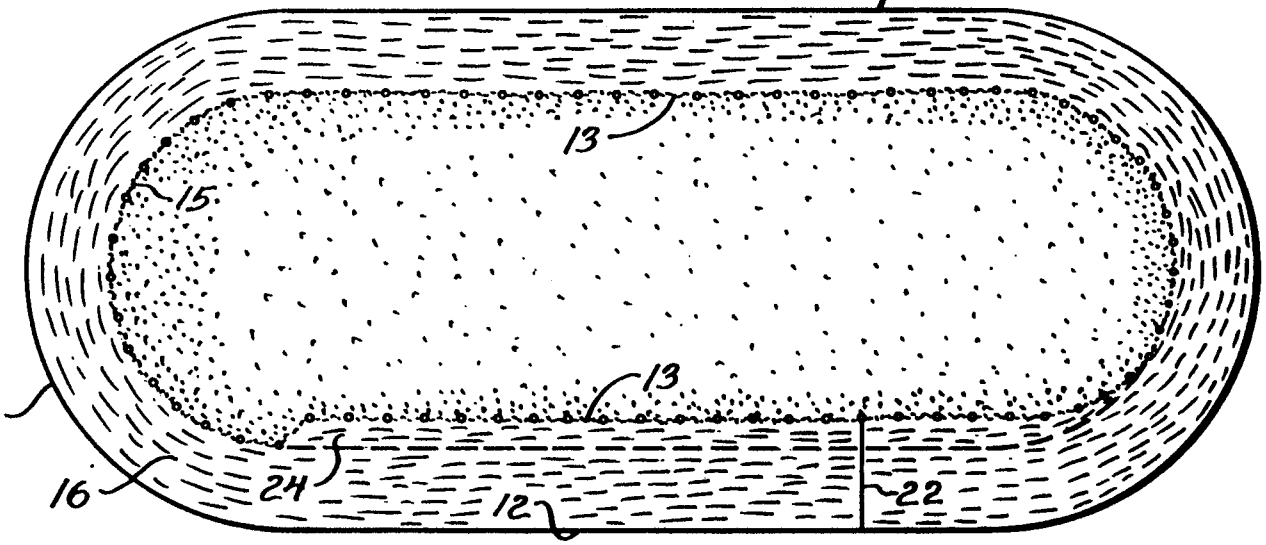

FIG. 1 shows the movable pylons 18 in position at the beginning of a race. FIG. 2 shows the movable pylons removed or laser-light demarcators turned off which occurs during the last portion of race. FIG. 2C can illustrate an alternative embodiment having no moveable pylons, or alternatively, with laser-light demarcators turned off, or moveable pylons removed. FIG. 2*b* can illustrate a racetrack with movable pylons in place sans, tether cords, or alternately with laser-light demarcations turned on.

During an actual horse race, the horses begin racing in a counter clockwise fashion at the start-finish line 22. The horses will typically make two complete laps around the racing surface 16. During the first lap, the racing surface 16 in the stretch portion 24 of the racetrack is defined by the distance between the movable pylons 18 and the outer barrier 12. As the last sulky passes the first movable pylon 18 at the beginning of the stretch 24, the movable pylon 18 is removed. This process is repeated successively for each movable pylon 18 along the entire stretch portion 24 including the stretch portions beyond the start-finish line 22, before the horses approach the beginning of the stretch portion 24 on the second and final lap.

FIG. 2 shows the stretch portion 24 of the race track 10 having a racing surface now defined by the stationary outer-barrier 12 and the stationary inner barrier 13 formed by the vertical posts or pylons 14. The increased width of the racing surface 16 is equal approximately to the length of the tether cord 20 plus the width of the movable pylons 18.

Thus, as the drivers approach the stretch portion 24 on the final lap, there will be additional racing room to the inside toward the inner barrier 13 to provide the driver with more room to maneuver the horse and sulky. Once past the start-finish line 22 on the second lap, the drivers slow down the horses immediately. There is no need to maintain the increased width of the racing surface 16 except a short distance past the start-finish line 22.

In addition to providing moveable pylons, another embodiment of the racetrack shown in FIGS. 2B and 2C includes a racetrack which has a fixed inner rail 13 which is offset from the curved portion 15. Although the inner rail could be offset by any distance, it is preferred that the inner rail is offset by approximately 8–10 feet. This arrangement would provide some extra room for the horses to maneuver in the stretch portion 24.

An offset approximately 8–10 feet not only minimizes the adjustment to the curved portions or the straight portions of the racetrack required to maintain the circumference, but also provides a safer track by minimizing the distance which the horses must move toward the rail 13 or eurorail when in the stretch 24 the first time. Also, because the pylons 18 would not have to be initially placed in an outer position and moved to an inner position, this embodiment would require less labor. Although the expanded inner lane exists throughout the race, a track rule may require that the horses not pass in the inner lane during the first lap.

FIG. 2B also shows how an existing race track can be modified to include an expanded inner lane as described above. Specifically, the inner rail 13 along the straight portion of the track is moved approximately 8–10 feet inward to form the inner lane. Because the straight portion of the racetrack is moved inward, either the curved portion 15 or the straight portion 13 of the racetrack must be adjusted to compensate for the loss of circumference 15. Preferably, the straight portions of the inner can be extended to maintain the diameter. Such an adjustment prevents any adjustment to the curvature of the turn. Specifically, the inner rail 13 along the straight portion could be extended by three feet on either side for a total of six feet. As a result, the curvature of the turn 15 is not changed. Also, this adjustment of the inner rail provides for longer straightaway in the stretch portion 24.

Instead of modifying the inner rail 13, it is also possible to modify one or both of the curves 15. Although this may lead to a slightly more narrow width in some regions of curved portion, the curve can be modified so that the inner and outer rails are substantially concentric. Specifically, the preferred distances extending from inner rail to the outer rail in this embodiment includes turns extending 100' and straightaways extending 80'.

Figures 3, 5, 6, 7:
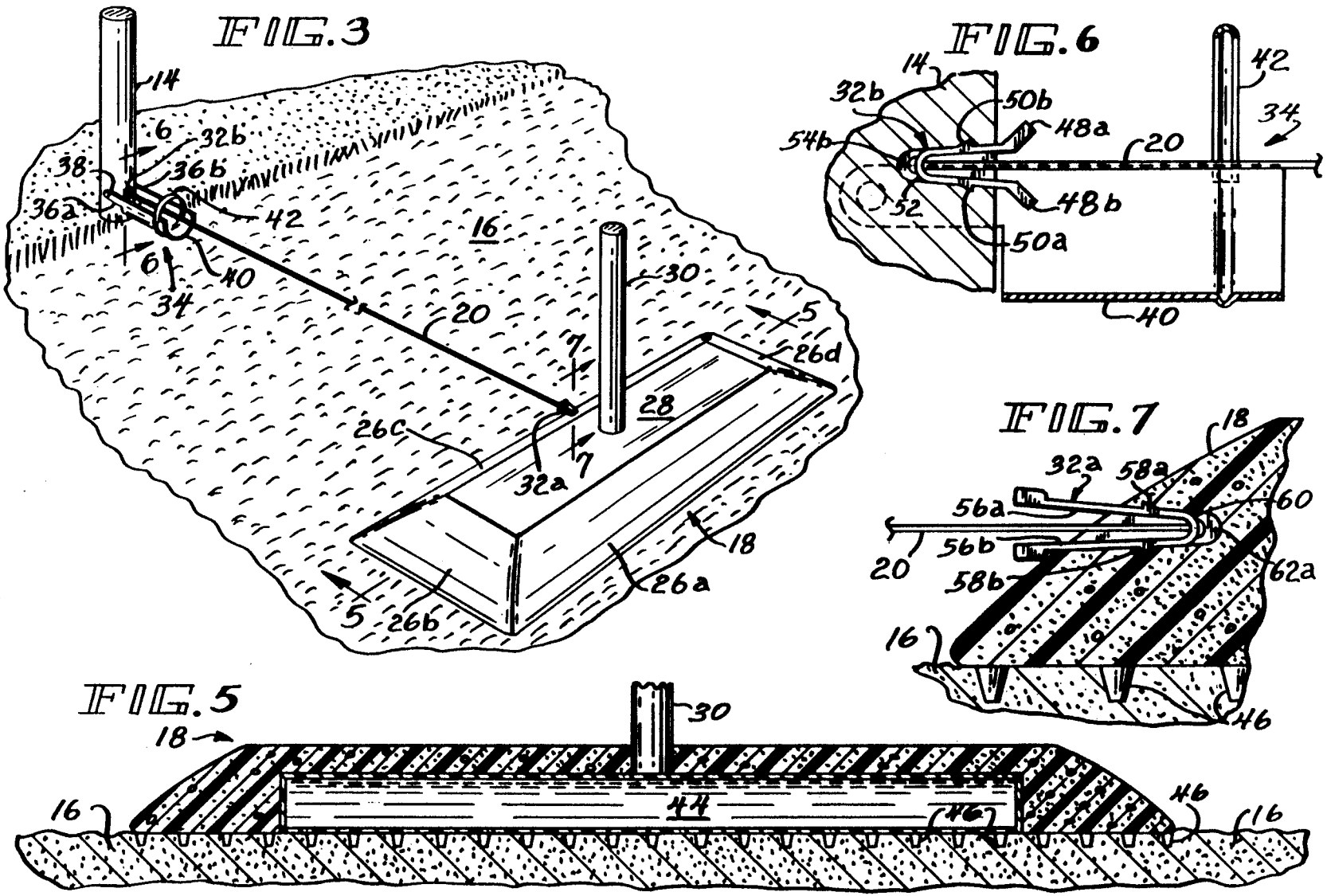
FIG. 3 is an enlarged perspective view of a movable pylon connecting to a vertical post or pylon forming a fixed interior barrier or eurorail.
FIG. 5 is a cross sectional view taken along lines 5—5 of FIG. 3.
FIG. 6 is a cross sectional view taken along lines 6—6 of FIG. 3.
FIG. 7 is a cross sectional view taken along lines 7—7 of FIG. 3.

FIG. 3 shows the movable pylon 18 having ramp surfaces **26*a*, 26*b*, 26*c*, 26*d* on which is formed an upper generally flat surface 28. The ramp surfaces 26*a*, 26*b*, 26*c*, 26*d* provide protection to horses and drivers racing in close proximity to the movable pylons 18, in that the sulky wheels may go over the ramp surfaces accidently without distabilizing the sulky carriage and causing potential harm to the driver or horse. The ramp surfaces 26*a*, 26*b*, 26*c*, 26*d* and the upper surface 28 are generally made of resilient material, such as heavy rubber, styrofoam or soft plastic, as is the entire body of the movable pylon 18**.

Vertical posts 30 extend upwardly from each movable pylon 18 to define the boundary for the racing surface 16 when the movable pylon 18 is in position. The vertical posts 30 are made of a flexible material to enable the post 30 to bend upon impact should this occur during the race. The vertical posts 30 may also be constructed to break away from the upper surface 28 upon impact.

A clip **32*a* at the end of the tether cord 20 is inserted into the ramp surface 26*c* of the movable pylon 18. The tether cord 20 extends from the movable pylon 18 toward the stationary inner post or pylon 14. The tether cord 20 is secured to the inner post or pylons 14 by means of a second clip 32*b* at the other end of cord 20. The width of the racing surface 16 during the second lap of the race is thus increased by the length of the tether cord 20 and the width of the movable pylon 18**.

A retractable limiting means 34 pivotally mounted to the stationary inner post or pylon 14 enables the user to place the movable pylon 18 in generally the same location before every race. The retractable limiting means 34 comprises a pair of pivotally mounted arms **36*a*, 36*b* affixed to the inner post or pylon 14 by means of a pin 38 extending approximately the diameter of the inner-barrier 13. When the movable pylon 18 is on the racing surface 16, the retractable limiting means 34 extends generally perpendicular to the inner vertical post or pylon 14. An open curved surface 40 is formed on the underside of the arms 36*a*, 36*b*. A rotatable half ring 42 is affixed to the curved underside 40 of the limiting means 34**.

In operation, the diameter of the limiting means 34, through which the tether cord 20 extends via visual sighting, limits the lateral movement of the tether cord, and hence, the placement of the movable pylons 18, resulting in the movable pylons 18 being placed in generally the same position race after race. The tether cord 20 should not touch the edges of the limiting means 34 once the movable pylon 18 is placed on the racing surface 16. The limiting means 34 provides a visual guide for the user in determining the perpendicular placement of the movable pylon 18 in relation to the inner vertical post or pylon 14. When the movable pylon 18 is positioned, the tether cord 20 is removed and the limiting means 34 is retracted to fit on the inner vertical post or pylon 14.

FIG. 5 is a detailed view of the interior of the movable pylon 18. As discussed previously, the ramp surfaces **26*a*, 26*b*, 26*c*, 26*d* and top surface 28 are made of a resilient material such as rubber, styrofoam or soft plastic. Within the interior of the pylon 18, a chamber 44 is formed which is capable of receiving and holding a liquid or other material for purposes of stabilizing the movable pylon 18 to prevent undesired movement during the race. Similarly, a series of cleats 46 extend from the underside of the pylon 18 into the racing surface 16. The liquid within the chamber 44 and the cleats 46 provides sufficient resistance to prevent movement of the movable pylon 18** from such factors as wind, but will not prevent the displacement of the movable pylons upon impact with a horse, sulky or driver.

FIG. 6 shows the arrangement of the clip **32*b* in the stationary inner post or pylon 14. The clip 32*b* comprises a pair of outwarding biased arms 48*a*, 48*b* having a pair of retentive shoulders 50a, 50b formed thereon. The arms are connected to one another by a curved end 52. Typically, the clip 32b is a one piece plastic construction. A corresponding receptacle 54b is formed in the stationary inner post or pylon 14 having a configuration paralleling the configuration of the clip 32b**.

Prior to the start of the race, the user squeezes the arms 48a, 48b, together and inserts the clip 32b into the receptacle 54b. Once completely inserted, the arms 48a, 48b are released and the clip 32b is retained within the receptacle 54b by the shoulders 50a, 50b abutting against the walls of a corresponding recess formed in the receptacle 54b. The tether cord 20 extends from the clip 32b through the limiting means 34 to the movable pylon 18.

FIG. 7 shows the arrangement of the clip 32a in the movable pylon 18. The clip 32a has a pair of outwardly biased arms 56a, 56b with a pair of retentive shoulders 58a, 58b, thereon. The outwarding biased arms 56a, 56b are joined by a curved end 60. As with clips 32b, clips 32a are typically formed of one piece plastic constructions. In the same manner as described above, prior to the start of the race, the clips 32a are inserted into receptacles 62a formed in the movable pylons 18 and having a configuration corresponding to that of the clip 32a. The arms 56a, 56b are squeezed together and the clip is inserted into the receptacle 62a. After the clip 32a is inserted completely into the receptacle 62a, the user releases the outwardly biased arms 56a, 56b and the clip 32a is retained within the receptacle 62a by the retentive shoulders 58a, 58b abutting against corresponding recesses formed in the receptacle 62a.

After the last horse and sulky have passed the first movable pylon 18 at the beginning of the stretch portion 24, the user picks up the pylon 18. The movable pylon 18 is then placed in a location away from the racing surface 16, and the stretch portion 24 of the racing surface 16 is enlarged by the desired width as discussed above. This process is repeated until all the movable pylons 18 are removed from the racing surface 16 prior to completion of the second lap.

Figures 4, 8, 9:
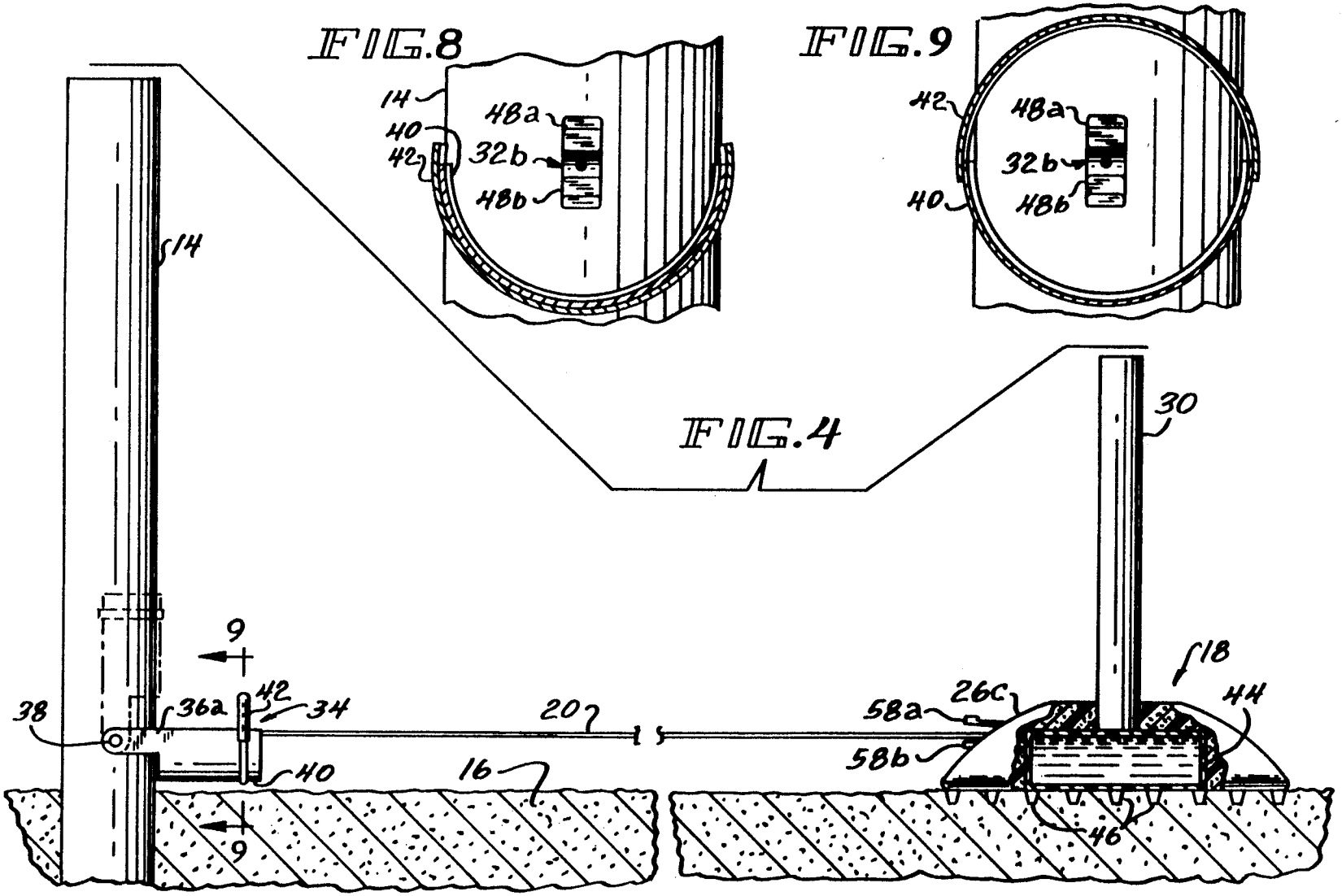
FIG. 4 is a side view of the movable pylon and fixed interior barrier or eurorail.
FIG. 8 is a cross sectional view showing the retractable limiting means in the horizontal position with the rotatable half ring open.
FIG. 9 is cross sectional view along lines 9—9 showing the retractable limiting means with the rotatable half ring closed.

FIGS. 4, 8 and 9 illustrate the limiting means 34 in extended and retracted modes. As shown in FIGS. 4 and 9, the limiting means 34 is in a generally horizontal position prior to the race, with the tether cord 20 confined within the diameter formed by the curved underside 40 and the now closed rotatable half ring 42 (FIG. 9). The diameter of the retractable limiting means 34 gives the user a visual guide for placement of the movable pylon 18. That is, the user knows that the tether cord 20 is to be taut, and that it should not touch the curved underside 40 or the rotatable half ring 42. In this manner, the movable pylon 18 will be placed generally in the same position before every race.

FIG. 8 illustrates the limiting means 34 in the horizontal position with the rotatable half ring 42 in the open position. The phantom lines in FIG. 4 illustrate the limiting means 34 in the retracted mode and the rotatable half ring 42 in the open position, positioned under the curved underside 40. This is the position the user would place the limiting means 34 and the rotatable half ring 42 after the movable pylons 18 have been positioned prior to the beginning of the race. When rotated to the vertical position, the limiting means 34 will be out of the way so as to avoid any injury to the horses or drivers entering the stretch portion 24. The diameter formed from the curved underside 40 is contemplated to be at least sufficiently large to surround a portion of the stationary inner post or pylon 14 when the limiting means 34 is rotated to the vertical position.

It is to be understood that, while the detail drawing and specific examples given described preferred embodiments of the invention, they are for the purpose of illustration only, that the apparatus of the invention is not limited to the precise details and conditions disclosed, and that various changes may be made therein such as mechanized embodiments and light or laser illuminations, without departing from the spirit of the invention which is defined by the following claims.

I claim:

1. A racetrack having means for modifying the width of selected portions of a racing surface comprising:

a stationary outer barrier extending around the outer periphery of the racetrack;

a stationary inner barrier positioned in the interior of the racetrack, which together with the outer barrier, define between them a racing surface of a prescribed width; and a movable barrier means releasably tethered to the stationary inner barrier, positioned between said outer barrier and said inner barrier, and capable of being moved prior to and during a race so as to modify the width of selected portions of the racing surface.

2. The racetrack according to claim wherein said stationary barrier comprises a series of vertical posts permanently positioned in the ground and spaced a prescribed distance from one another.

3. The racetrack according to claim 2 wherein a limiting means is affixed to the stationary inner posts so as to enable said movable barrier means to be positioned in generally the same location before each race.

4. The racetrack according to claim 3 wherein said limiting means pivots about said stationary inner posts.

5. The racetrack according to claim 1 wherein said movable barrier means comprises multiple pylons each having a weighted base, a vertical post extending upwardly from the base; receptacle means for receiving a tethering means extending between said stationary inner barrier and said movable barrier, and cleats extending downwardly from the base into the ground to provide stability.

6. A race track having a racing surface capable of being varied in its width dimension at selected locations prior to and during a race, comprising: 1 a stationary outer barrier extending around the outer periphery of the racetrack;

a stationary inner barrier which, together with the outer boundary, define a racing surface between them of a prescribed width;

a movable barrier positioned between the outer barrier and inner barrier and capable of being easily relocated during a race, the movable barrier comprising a base, a vertical post extending upwardly from said base, and releasable tethering means connecting said movable barrier and said stationary inner barrier; and limiting means mounted to said stationary inner barrier to enable the repeated placement of the movable barrier in a desired location without substantial deviation.

7. The racetrack according to claim 6 wherein said tethering means comprises a cord of a desired length with releasable clips formed on each end, and corresponding receptacles formed on the inner barrier and the movable barrier which are capable of receiving the clips.

8. A method of altering the size of a racing surface of a racetrack prior to and during a race comprising:

placing an outer stationary barrier around the perimeter of a race course;

placing an stationary barrier inwardly from said outer stationary barrier so as to define a racing surface between said inner and outer barriers;

connecting one end of a tether cord of a defined length to said inner stationary barrier prior the beginning of a race;

connecting the other end of said tether cord prior to the beginning of the race to a movable barrier placed at a defined location between the inner and outer stationary barriers on the racing surface; and moving said movable barriers off of the racing surface during the race so as to enlarge the width of th racing surface a defined amount.

9. An asymmetrical racetrack having different widths at selected portion of a racing surface comprising:

a stationary outer barrier having first and second generally curved portions and first and second generally straight portions and extending around the outer periphery of the racetrack;

a stationary inner barrier having first and second generally curved portions and first and second generally straight portions positioned in the interior of the racetrack, which together with the outer barrier, define between them a racing surface of a prescribed width having first and second generally curved portions and first and second generally straight portions;

wherein said first generally straight portion of said stationary inner barrier is inwardly offset from said first generally curved portion and positioned parallel to the outer barrier to increase the width of said first generally straight portion of the racing surface relative to said first generally curved portion;

wherein at least a portion of said second generally curved portion of said inner barrier is not concentric to said second generally curved portion of said outer barrier.

10. The racetrack according to claim 9 further including laser-light demarcators to define an inner barrier which is not inwardly offset from the curved portion.

11. The racetrack according to claim 9 wherein said first generally straight portion is inwardly offset from said first generally curved portion by approximately 8–10 feet.

12. The racetrack according to claim 9 wherein said second generally curved portion of said inner barrier has the same or substantially the same curvature as said second generally curved portion of said outer barrier.

13. A method of altering the size of a racing surface of an existing racetrack having first and second generally straight portions and first and second generally curved portion and having an inner stationary barrier and an outer stationary barrier which are substantially parallel including the steps of:

moving said first generally straight portion of the inner barrier toward the center of the racetrack relative to said first generally curved portion to expand the width of the racing surface in said first generally straight portion and provide an inner lane for the horses to pass; and adjusting said inner barrier of said second generally curved portion of the stationary inner barrier to accommodate said expanded width of the racing surface in said first generally straight portion and to maintain the initial circumference of the racing surface.

14. The method of claim 13 wherein said racetrack includes two substantially straight portion and two substantially curved portions.

15. The method of claim 14 wherein the step of adjusting at least one portion of the stationary inner barrier includes extending the inner stationary boundary of the straight portions.

16. The method of claim 15 wherein the inner stationary boundary is extended by approximately 3–6 feet.

17. The method of claim 13 further including the step of altering the length of said first and second generally straight portions of said inner stationary barrier to maintain the initial circumference of said existing racetrack.

18. The method of claim 17 wherein the step of adjusting said inner barrier of said second generally curved portion includes adjusting said inner barrier of said second generally curved portion to maintain a perfect curve.

19. The method of claim 14 wherein the step of adjusting at least one portion of the inner stationary barrier includes adjusting a curved portion of the inner stationary boundary.

20. The method of claim 13 wherein the step of moving said first generally straight portion includes moving said straight portion of the inner barrier approximately 8–10 feet toward the center of the track relative to said inner portion of said first generally curved portion.

* * * * *

UNITED STATES PATENT AND TRADEMARK OFFICE

CERTIFICATE OF CORRECTION

PATENT NO. : 5,240,459

DATED : August 31, 1993

INVENTOR(S) : Richard A. Herbert

It is certified that error appears in the above-indentified patent and that said Letters Patent is hereby corrected as shown below:

Col. 1, line 27, insert --a-- before "sulky".

Col. 3, line 57, change "FIG. 2B" to --FIG. 2--.

Col. 4, line 46, change "FIG. 2C" to --FIGS. 2 and 2C--.

Col. 4, line 49, change "FIG. 2b" to --FIG. 2B--.

Col. 5, line 16, change "FIGS. 2B" to --FIGS. 2--.

Col. 5, line 35, change "FIG. 2B" to --FIG. 2--.

Col. 5, line 44, insert --rail-- after "inner" and change "diameter" to --circumference--.

Col. 5, line 47, insert --typically-- before "three".

Col. 5, line 50, insert --a slightly-- before "longer".

Col. 5, line 55, insert --the-- before "curved".

Signed and Sealed this

Twenty-sixth Day of April, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,240,459

DATED : August 31, 1993

INVENTOR(S) : Richard A. Herbert

It is certified that error appears in the above-identified patent and that said Letters Patent is hereby corrected as shown below:

Col. 9, line 21, change "portion" to -- portions --;

Col. 9, line 39, after "portion" insert

-- wherein said first generally curved portion of said inner barrier is substantially concentric to said first generally curved portion of said outer barrier, and--

Signed and Sealed this

Fifteenth Day of November, 1994

Bruce Lehman

*Attest:*

BRUCE LEHMAN

*Attesting Officer*

*Commissioner of Patents and Trademarks*